US007943875B2

(12) United States Patent
Chu

(10) Patent No.: US 7,943,875 B2
(45) Date of Patent: May 17, 2011

(54) SWITCH STRUCTURE INTEGRATED WITH DISPLAY AND PLAYBACK DEVICE

(76) Inventor: Gear Chu, Taipei (TW)

( * ) Notice: Subject to any disclaimer, the term of this patent is extended or adjusted under 35 U.S.C. 154(b) by 382 days.

(21) Appl. No.: 12/317,660

(22) Filed: Dec. 29, 2008

(65) Prior Publication Data

US 2009/0301849 A1 Dec. 10, 2009

(30) Foreign Application Priority Data

Jun. 6, 2008 (TW) ..... 97209962 U

(51) Int. Cl.
*H01H 1/64* (2006.01)

(52) U.S. Cl. ..... 200/293

(58) Field of Classification Search ..... 200/293, 200/237, 314, 530

See application file for complete search history.

(56) References Cited

U.S. PATENT DOCUMENTS 4,419,555 A * 12/1983 Kim ..... 200/314
4,987,279 A * 1/1991 Hirose et al. ..... 200/314
5,072,085 A * 12/1991 Shinohara et al. ..... 200/314
5,278,362 A * 1/1994 Ohashi ..... 200/5 A
5,803,242 A * 9/1998 Takano et al. ..... 200/530
7,180,025 B2 * 2/2007 Kuwana et al. ..... 200/520
2007/0246337 A1 * 10/2007 Verdu et al. ..... 200/314

* cited by examiner

*Primary Examiner* — Edwin A. Leon
*Assistant Examiner* — Vanessa Girardi

(57) ABSTRACT

A switch structure integrated with a display and playback device is provided. Therein, a lower housing has a rectangular through-hole, a conductor through-hole, a terminal through-hole and a guide post formed peripherally with semi-cylindrical ribs. The display and playback device is equipped with a bus line and display and playback device terminals, and covered with a display and playback device housing, which in turn is covered by a transparent cover. A conductor and a terminal are inserted in the conductor through-hole and the terminal through-hole, respectively. Resilient elements are provided between the lower housing and an actuation element having a guide post through-hole for cooperating with the guide post. Upon movement of the actuation element relative to the lower housing, the ribs on the guide post make contact with an inner wall of the guide post through-hole, allowing the actuation element to move smoothly, vertically relative to the lower housing.

3 Claims, 5 Drawing Sheets

SWITCH STRUCTURE INTEGRATED WITH DISPLAY AND PLAYBACK DEVICE

BACKGROUND OF THE INVENTION

1. Technical Field

The present invention relates to a switch structure and, more particularly, to a switch structure integrated with a display and playback device, wherein resilient elements are provided between an actuation element and a lower housing to facilitate relative movement therebetween, and the lower housing has a guide post formed with ribs which allow the actuation element to move smoothly and vertically relative to the lower housing.

2. Description of Related Art

Switches are commonly used to make or break electrical circuits, and switches of different structures are actuated in different ways, such as by pressing, rotating, pulling switch levers, and so on. A switch structure actuated by pressing a button thereof is typically provided with a lower housing or base, which is spaced apart from an actuation element by a proper gap to enable smooth back-and-forth movement of the button during use. However, the very gap also requires that force applied to the switch structure be perpendicular to a force-application surface of the button; otherwise, components inside the button structure tend to be stuck or input the same signal repeatedly, causing a lot of trouble in case of emergency.

BRIEF SUMMARY OF THE INVENTION

In view of the aforementioned problems, the present invention provides an improved switch structure to facilitate relative movement between the actuation element and the lower housing.

The present invention provides a switch structure integrated with a display and playback device, wherein the display and playback device is equipped with a bus line connected with display and playback device terminals, and a display and playback device housing is disposed above the display and playback device and covered by a transparent cover. In addition, a lower housing is provided with a guide post having a periphery formed with a plurality of semi-cylindrical ribs, a rectangular through-hole for being inserted by the display and playback device terminals, a conductor through-hole for being inserted by a conductor, and a terminal through-hole for being inserted by a terminal. Resilient elements are provided between the lower housing and an actuation element having a guide post through-hole for cooperating with the guide post of the lower housing. The semi-cylindrical ribs on the periphery of the guide post come into contact with an inner wall of the guide post through-hole linearly and thus generates little friction therebetween. Consequently, the actuation element is allowed to move vertically and smoothly relative to the lower housing without being stuck during operation of the switch structure. Besides, the display and playback device also serves to enhance work efficiency.

BRIEF DESCRIPTION OF THE SEVERAL VIEWS OF THE DRAWINGS

The invention as well as a preferred mode of use, further objectives and advantages thereof will be best understood by referring to the following detailed description of an illustrative embodiment in conjunction with the accompanying drawings, wherein.

DETAILED DESCRIPTION OF THE INVENTION

Figure 1:
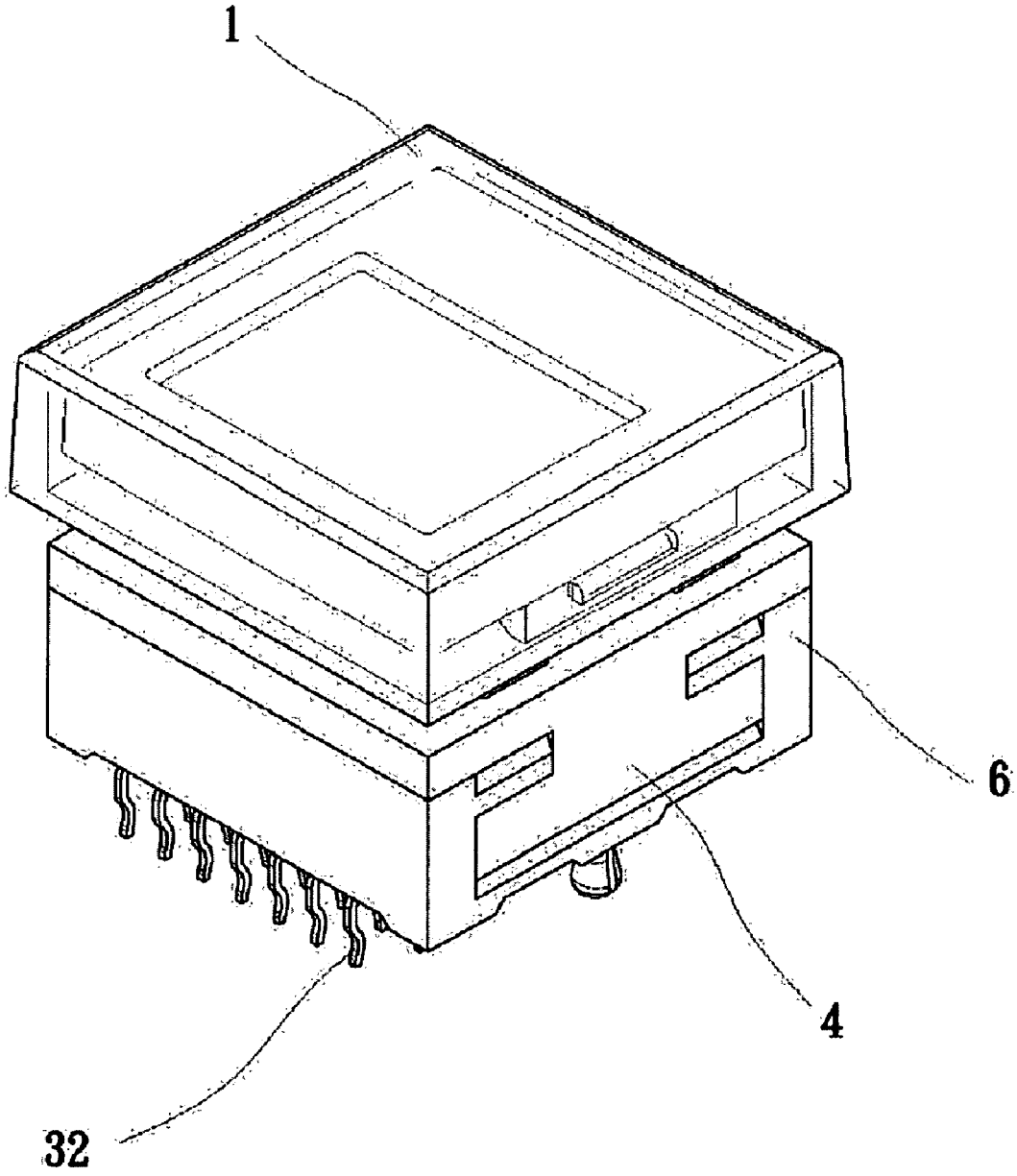
FIG. 1 is a perspective view of a switch structure according to the present invention.
Figure 2:
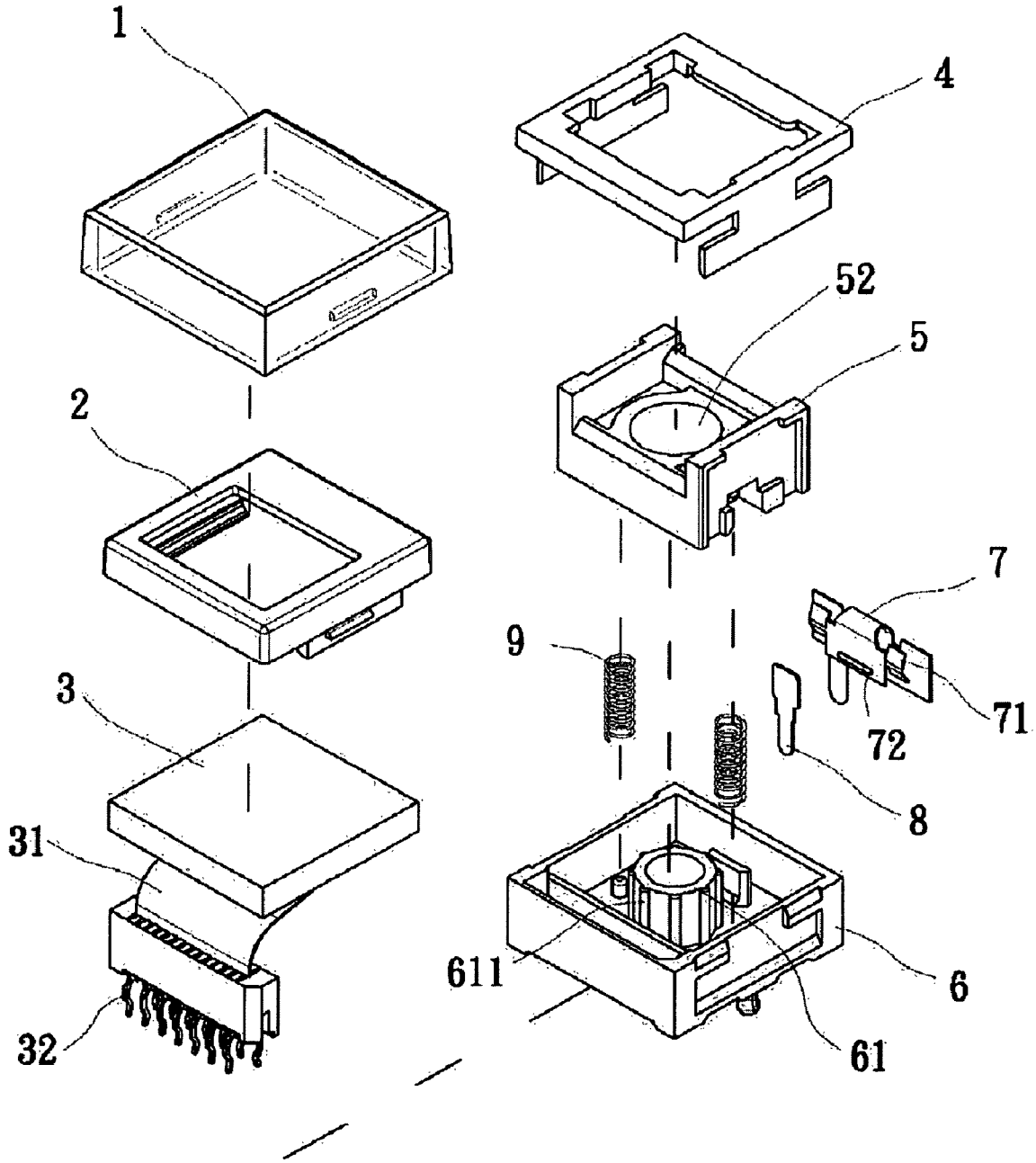
FIG. 2 is an exploded, perspective view of the switch structure according to the present invention.
Figure 3:
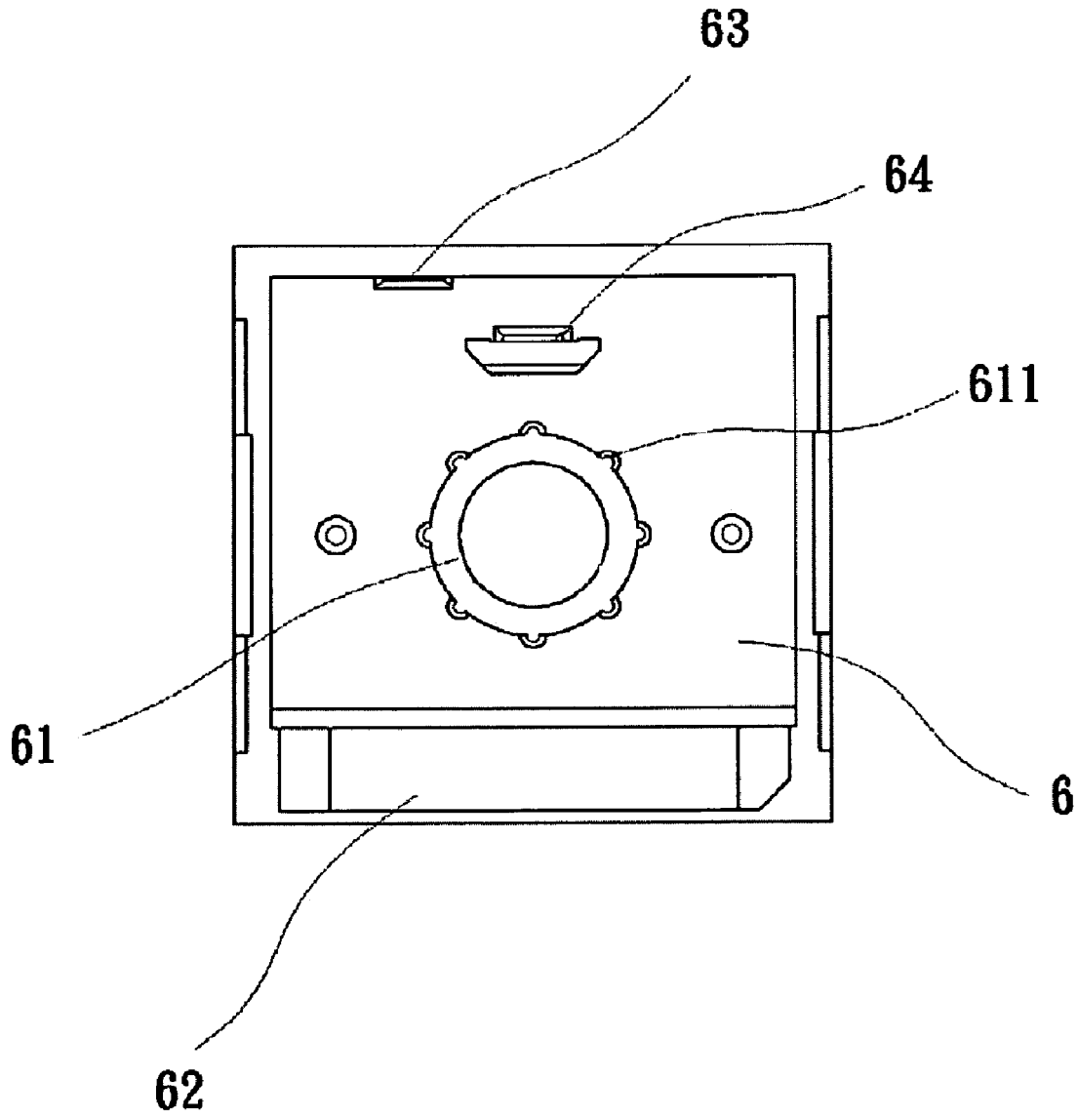
FIG. 3 is a top view of a lower housing of the switch structure according to the present invention.

The structure and functions of the present invention are now described in detail by reference to a preferred embodiment and the accompanying drawings. Referring to FIGS. 1 to 6, a switch structure integrated with a display and playback device according to the present invention essentially includes a transparent cover 1, a display and playback device housing 2, the display and playback device 3, an outer housing 4, an actuation element 5, a lower housing 6, a conductor 7, a terminal 8, and a plurality of resilient elements 9. As shown in FIGS. 2 and 3, the transparent cover 1 is disposed above and covers the display and playback device housing 2, which in turn is disposed above the display and playback device 3. The display and playback device 3 is located above the actuation element 5 and equipped with a bus line connected with display and playback device terminals 32. The lower housing 6 has a rectangular through-hole 62 for being inserted by the display and playback device terminals 32, a conductor through-hole 63 for being inserted by the conductor 7, and a terminal through-hole 64 for being inserted by the terminal 8. In addition, the lower housing 6 is centrally provided with a guide post 61 which has a periphery formed with ribs 611 for cooperating with a guide post through-hole 52 of the actuation element 5. The resilient elements 9 are located bilaterally with respect to the guide post 61 to support the actuation element 5 and other components disposed thereabove. The outer housing 4 engages with the lower housing 6 and thereby restricts relative positions of the actuation element 5 and the lower housing 6.

Figure 5:
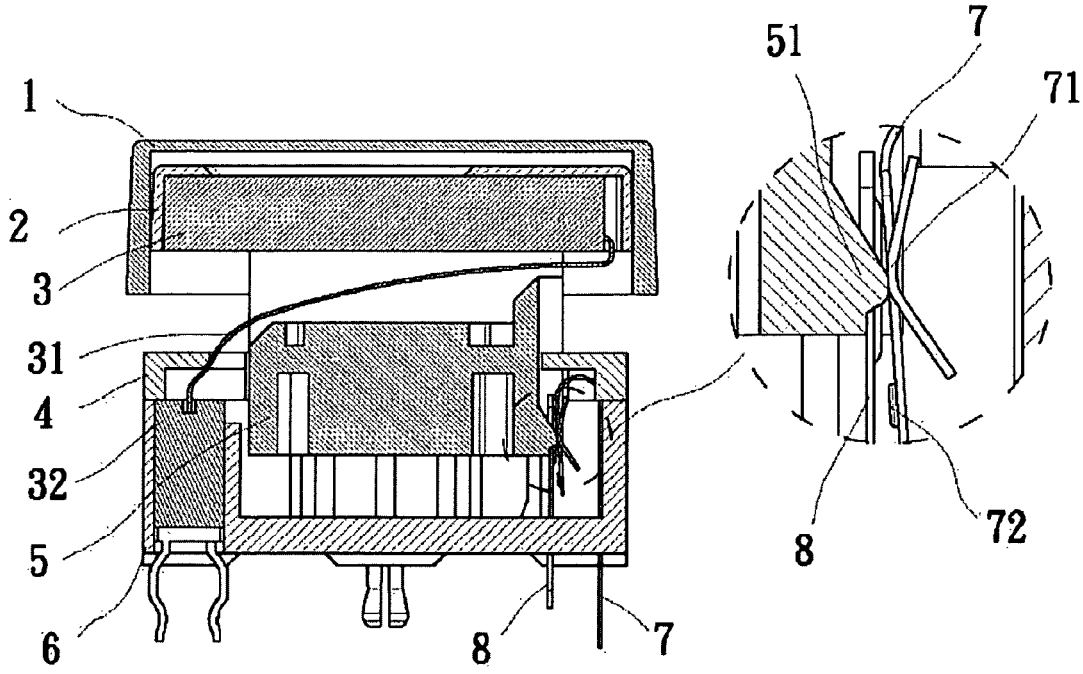
FIG. 5 shows the switch structure according to the present invention in an OFF state.
Figure 6:
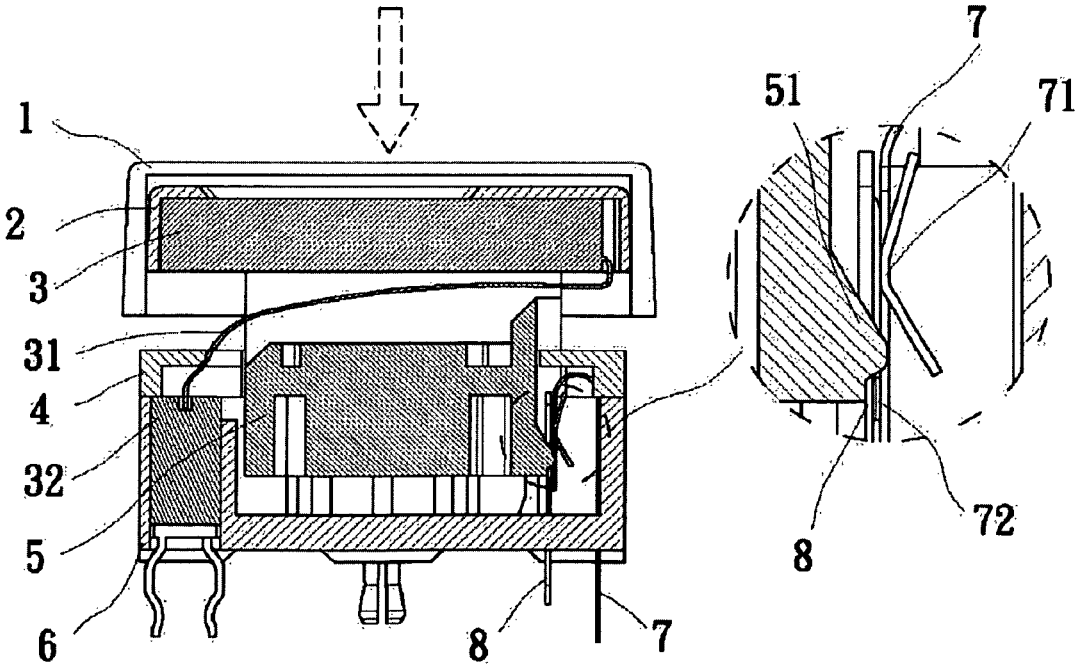
FIG. 6 shows the switch structure according to the present invention in an ON state.

Referring to FIG. 5, when the switch structure integrated with the display and playback device 3 is not pressed by a downward force, a flange 51 of the actuation element 5 is in contact with a bent portion 71 of the conductor 7 to prevent a flange 72 of the conductor 7 from contacting the terminal 8, thus breaking an electrical circuit connected with the switch structure. Referring now to FIG. 6, when the switch structure is pressed by a downward force, the actuation element 5 is moved downward to compress the resilient elements 9. As a result, the flange 51 of the actuation element 5 is disengaged from the bent portion 71 of the conductor 7, allowing the flange 72 of the conductor 7 to move to the left and contact the terminal 8, thereby closing the electrical circuit.

Figure 4:
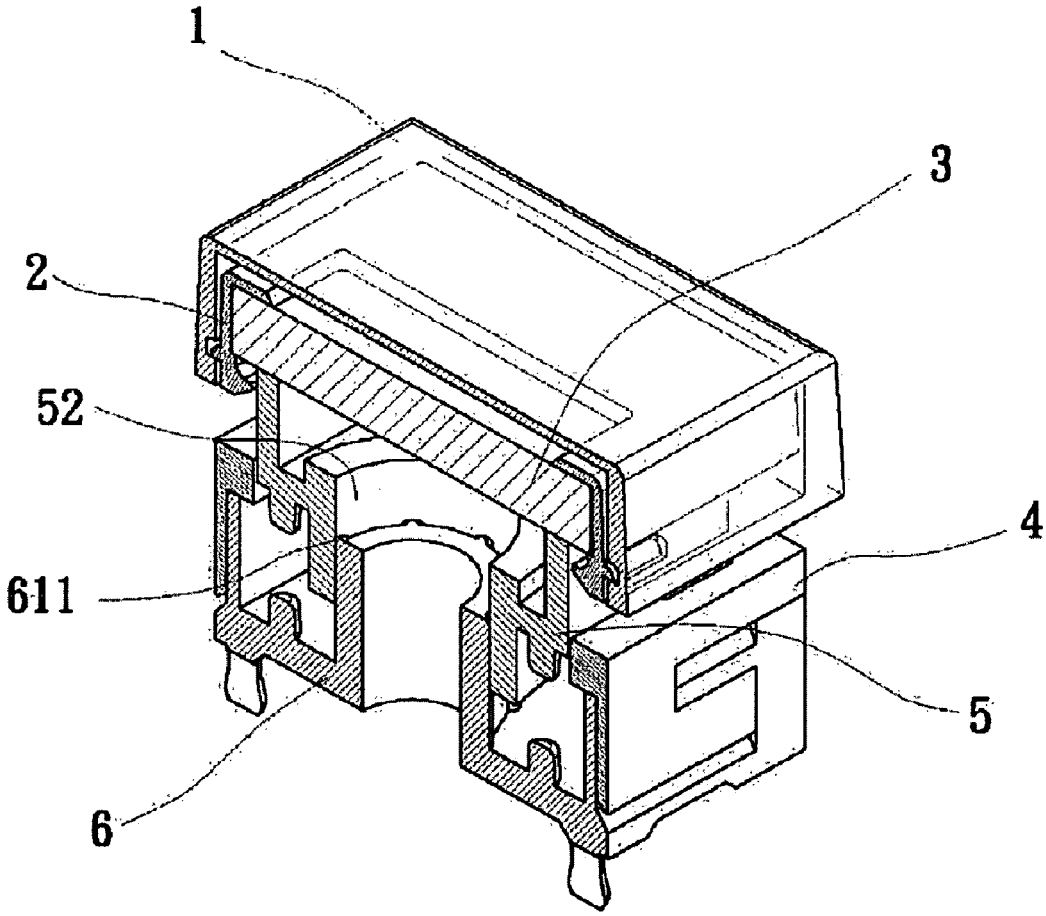
FIG. 4 is a sectional, perspective view of the switch structure according to the present invention.

As shown in FIG. 4, the guide post 61 of the lower housing 6 is in cooperation with the guide post through-hole 52 of the actuation element 5, wherein the semi-cylindrical ribs 611 on the periphery of the guide post 61 make linear contact with the inner wall of guide post through-hole 52 and generate little friction therebetween. In consequence, the actuation element 5 is allowed to move smoothly relative to the lower housing 6, and the displacement therebetween is vertical. Besides, the display and playback device 3 can switch between different images in response to the actuation of the actuation element 5, or perform a display and playback function independently, resulting in enhanced operation efficiency.

The invention claimed is:

1. A switch structure integrated with a display and playback device, comprising:

a lower housing formed with a rectangular through-hole, a conductor through-hole, a terminal through-hole, and a guide post having a periphery provided with ribs;

the display and playback device equipped with a bus line connected with display and playback device terminals, the display and playback device terminals being inserted in the rectangular through-hole of the lower housing;

an actuation element disposed above the lower housing, centrally formed with a guide post through-hole, and laterally formed with a flange;

at least one resilient element interposed between the lower housing and the actuation element;

a conductor inserted in the conductor through-hole of the lower housing and formed with a bent portion and a flange;

a terminal inserted in the terminal through-hole of the lower housing and, upon contact with the flange of the conductor, turning the switch structure into an ON state;

a display and playback device housing disposed above the display and playback device so that the display and playback device is located above the actuation element;

a transparent cover disposed above and covering the display and playback device housing; and an outer housing engaging with the lower housing for restricting relative positions of the actuation element and the lower housing;

the switch structure being characterized in that:

the ribs on the periphery of the guide post come into contact with the guide post through-hole upon movement of the guide post through-hole of the actuation element relative to, and in cooperation with, the guide post of the lower housing.

2. The switch structure of claim 1, wherein the conductor and the terminal are not connected with the display and playback device.

3. The switch structure of claim 1, wherein the ribs on the periphery of the guide post are semi-cylindrical.

* * * * *